United States Patent [19]

Olson

[11] Patent Number: 5,030,069

[45] Date of Patent: Jul. 9, 1991

[54] MATERIAL MOVING PUMP

[76] Inventor: David A. Olson, 1708 Roberts Dr., Albert Lea, Minn. 56007

[21] Appl. No.: 472,343

[22] Filed: Jan. 30, 1990

[51] Int. Cl.[5] ..... F04B 39/10

[52] U.S. Cl. ..... 417/489; 417/900

[58] Field of Search ..... 417/403, 489, 900

[56] References Cited

U.S. PATENT DOCUMENTS

| | | | |
|---|---|---|---|
| 3,331,332 | 7/1967 | Wennberg | 417/400 |
| 4,140,443 | 2/1979 | Olson | 417/900 |
| 4,290,737 | 9/1981 | Clay | 417/489 |
| 4,322,023 | 3/1982 | Olson . | |

*Primary Examiner*—Leonard E. Smith
*Assistant Examiner*—Charles G. Freay
*Attorney, Agent, or Firm*—Robert W. Gutenkauf; L. Paul Burd; Richard O. Bartz

[57] ABSTRACT

A sanitary material moving pump having a ram mounted for reciprocal movement in a pumping chamber. An elongte tubular housing is connected at one end to the ram for purposes of reciprocal movement of the ram to move material through the pumping chamber. A piston shaft is mounted in stationary relationship relative to the pumping chamber in alignment with the design pumping axis of the pumping chamber. The end of the housing opposite the ram extends outward of the pumping chamber and is installed on the working end of the piston shaft. A piston is mounted on the inside end of the piston shaft. Hydraulic fluid lines communicate with opposite sides of the piston to reciprocate the housing on the piston shaft and the ram in the pumping chamber. Apparatus is provided for correctly adjusting the alignment of the hydraulic power unit to be as coincident as possible with the design pumping axis of the machine.

19 Claims, 5 Drawing Sheets

MATERIAL MOVING PUMP

BACKGROUND OF THE INVENTION

Material moving pumps, whether for moving liquids, solids or liquid entrained discrete solid material, or other product, for example manure, straw, crushed animal bones, sawdust, or feathers, typically include a ram that reciprocates in a pumping chamber undergoing a working stroke or power stroke during which material is moved through the chamber, and a return stroke whereby the ram returns to its starting position and more material is introduced into the chamber ahead of it. The ram is driven by a hydraulic motor of the cylinder-piston variety with the cylinder mounted in stationary relationship to and outside of the pumping chamber. The piston-rod is attached to the ram and reciprocates in the chamber. For example, see U.S. Pat. No. 4,322,023 to Olson issued Mar. 30, 1982 entitled Material Moving Apparatus. Such pumps are satisfactory for the pumping of most materials. However certain materials require a high degree of sanitation when being handled, such as food or food ingredients, or substances used in the manufacture of drugs and chemical products where purity is important. The presence of a piston shaft that reciprocates in and out of a cylinder can contaminate the environment of the pumping chamber, rendering the use of such pumps undesirable for handling these materials.

SUMMARY OF THE INVENTION

The invention pertains to a material moving pump particularly adapted for movement of material requiring a clean environment such as food or food ingredients, or chemicals requiring a high degree of purity, or the like. A ram is mounted for reciprocal movement in a pumping chamber where material to be pumped is introduced through a hopper or equivalent structure. The ram is connected to and moves with an elongate tubular housing that is contructed whereby a portion of the housing opposite the ram functions as a cylinder portion of a hydraulic motor of the piston-cylinder variety. The housing extends outward of the pumping chamber. A piston shaft is mounted in cantilever fashion in stationary relationship relative to the pumping chamber in alignment with the designed pumping axis of the chamber. A working end of the piston shaft is located inside the open end of the housing. A piston is mounted on the inside end of the piston shaft. First and second hydraulic lines communicate with opposite sides of the piston. Introduction of hydraulic fluid under pressure on one side of the piston is effective to move the cylinder away from the piston or move the ram in a forward direction in the pumping chamber. The introduction of hydraulic fluid on the other side of the piston is effective to pull the housing back or move the ram rearwardly in the pumping chamber. In such fashion, the ram is reciprocated in the pumping chamber. Only the end of the housing connected to the ram enters the pumping chamber. The hydraulic connections are remote from the pumping chamber as can be the working portion of the hydraulic motor to avoid contamination. The piston shaft is not vulnerable to damage as might occur when pumping abrasive materials. Elongate support structure constituted as an extention of the pumping chamber walls rearward of the pumping chamber supports the end of the shaft. This structure is also used to determine correct alignment of the shaft and housing with respect to the pumping chamber. Means are provided for adjustment of the housing and the shaft in order to correctly realign them with the design pumping axis of the pumping chamber when necessary. The piston shaft is remote from the material being pumped.

IN THE DRAWINGS

DESCRIPTION OF A PREFERRED EMBODIMENT

Figure 1:
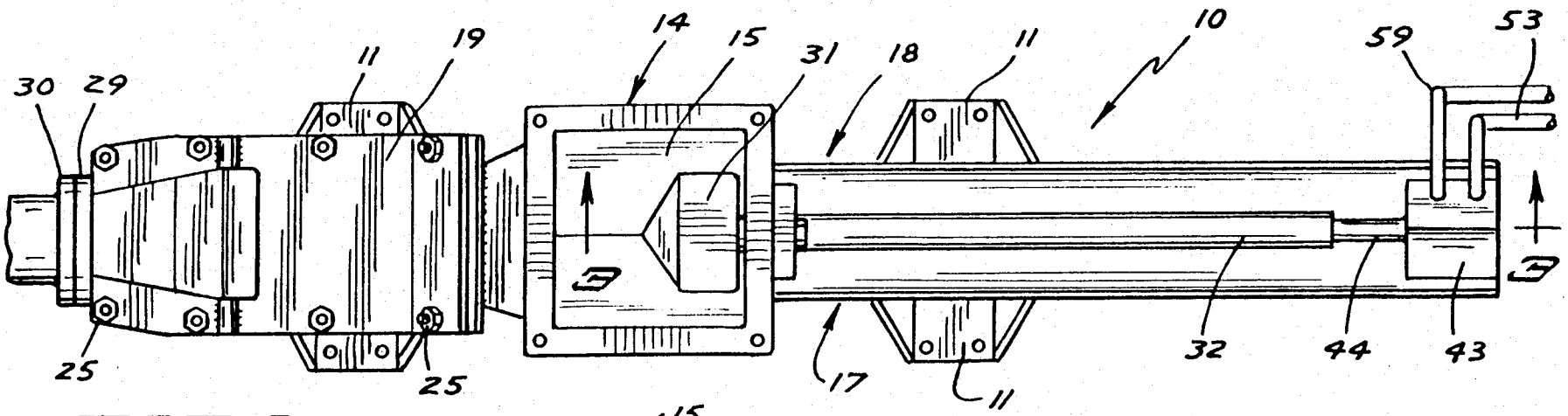
FIG. 1 is a top plan view of a material moving pump according to the present invention.
Figure 2:
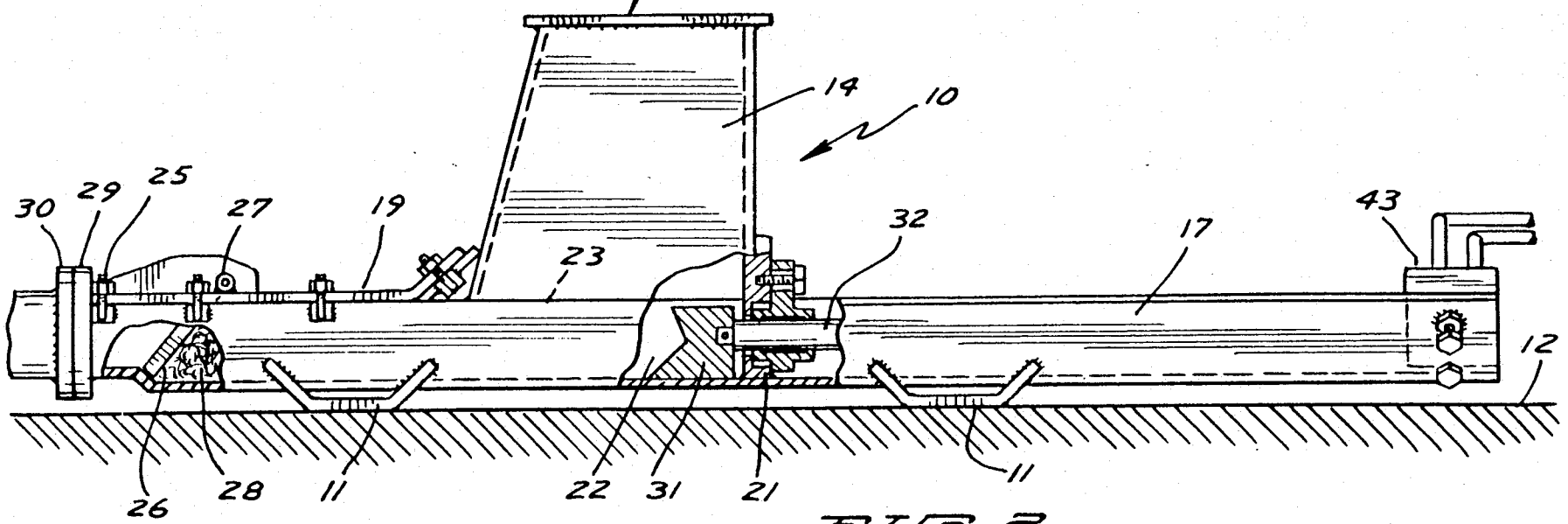
FIG. 2 is a side elevational view of the material moving pump of FIG. 1 with sections removed for purposes of illustration.
Figure 6:
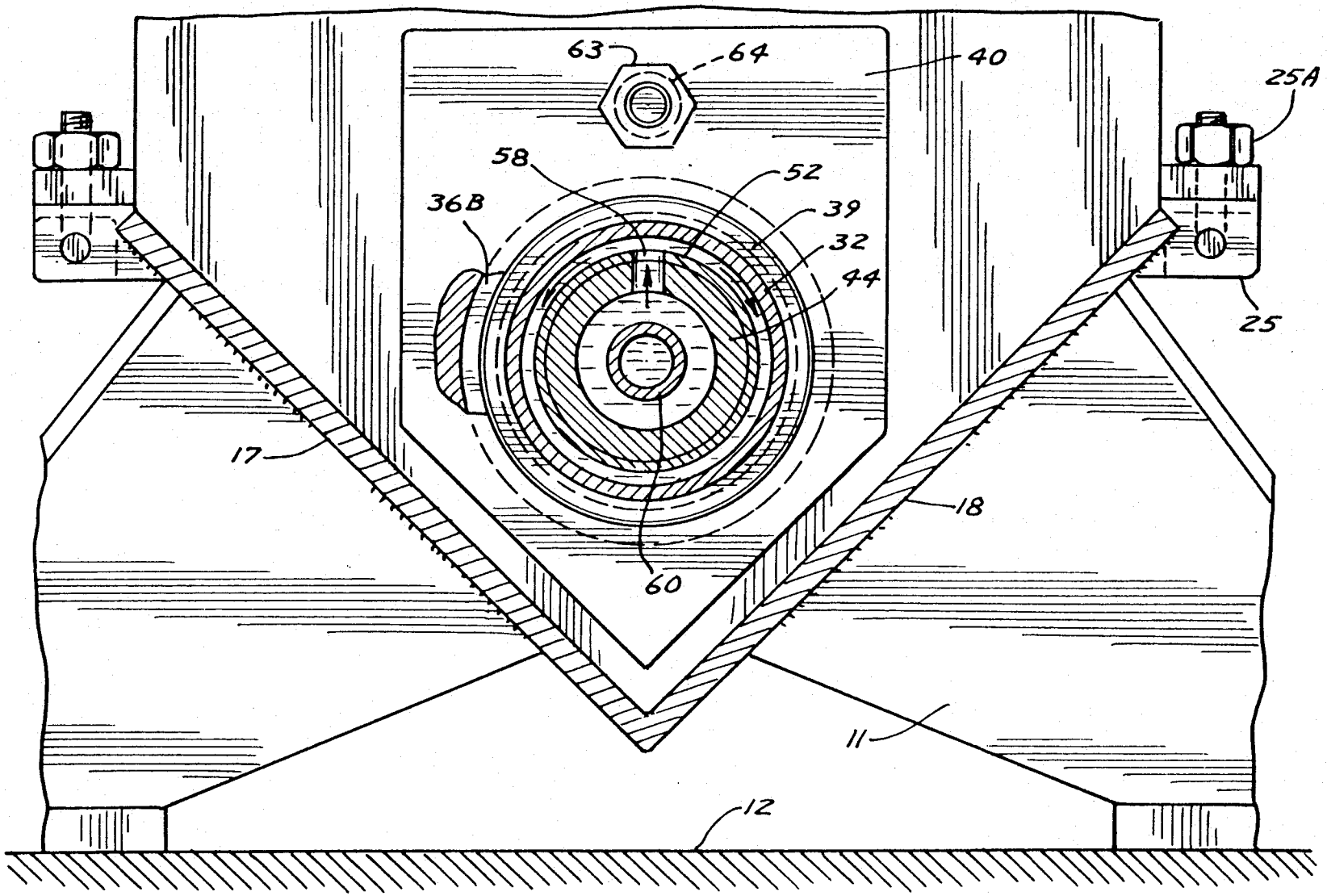
FIG. 6 is an enlarged sectional view of a portion of the material moving pump shown in FIG. 4 taken along the line 6—6 thereof.

Referring to the drawings, there is shown in FIGS. 1 and 2 a material moving pump indicated generally at 10 mounted on stand-like legs 11 for support with respect to a ground surface 12. Pump 10 includes an upright hopper 14 for introduction of material to be pumped through an open, flanged hopper mouth 15. Pump 10 has side walls 17, 18 that are orientated in an upwardly open V-configuration (FIG. 6). A pumping chamber 22 is defined by the forward portions of side walls 17, 18 and by a rear wall 21 located substantially in vertical alignment with the rear wall of hopper 14. A removable top wall or cover 19 closes the top forward portion of pumping chamber and hopper 14 covers an inlet opening 23 to pumping chamber 22 at the rear portion thereof. Cover 19 is releasably fastened to side walls 17, 18 by fastening assemblies 25 comprised as elongate threaded members pivotally connected to the upper edges of the side walls movable into engagement with notches on the edge of cover 19 and secured there by nuts 25A. Cover 19 is removable for purposes of access to chamber 22 for cleaning or the like.

The forward end of pumping chamber 22 is closed by a one-way valve comprised as a closure plate or spring loaded gate 26. Gate 26 rotates about a transverse pivot 27 located above the main portion of pumping chamber 22 in an upward extension of cover 19. Forward of gate 26 side walls 17, 18 define a transition region leading to a flanged outlet 29 of pump 10 connected to a flanged inlet 30 of a suitable transfer pipe.

Figure 3:
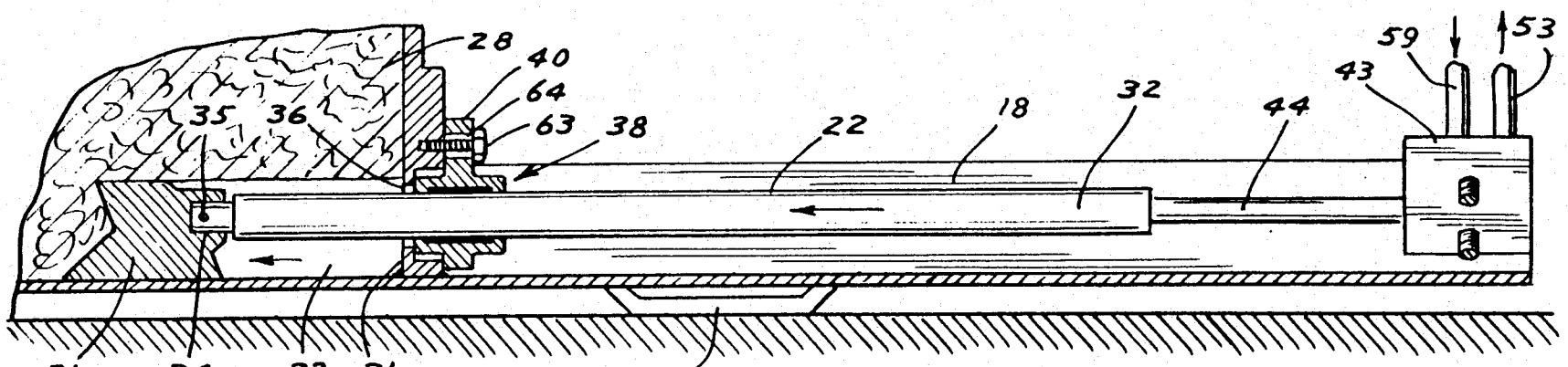
FIG. 3 is an enlarged sectional view of a portion of the material moving pump of FIG. 1 taken along the line 3—3 thereof.
Figure 4:
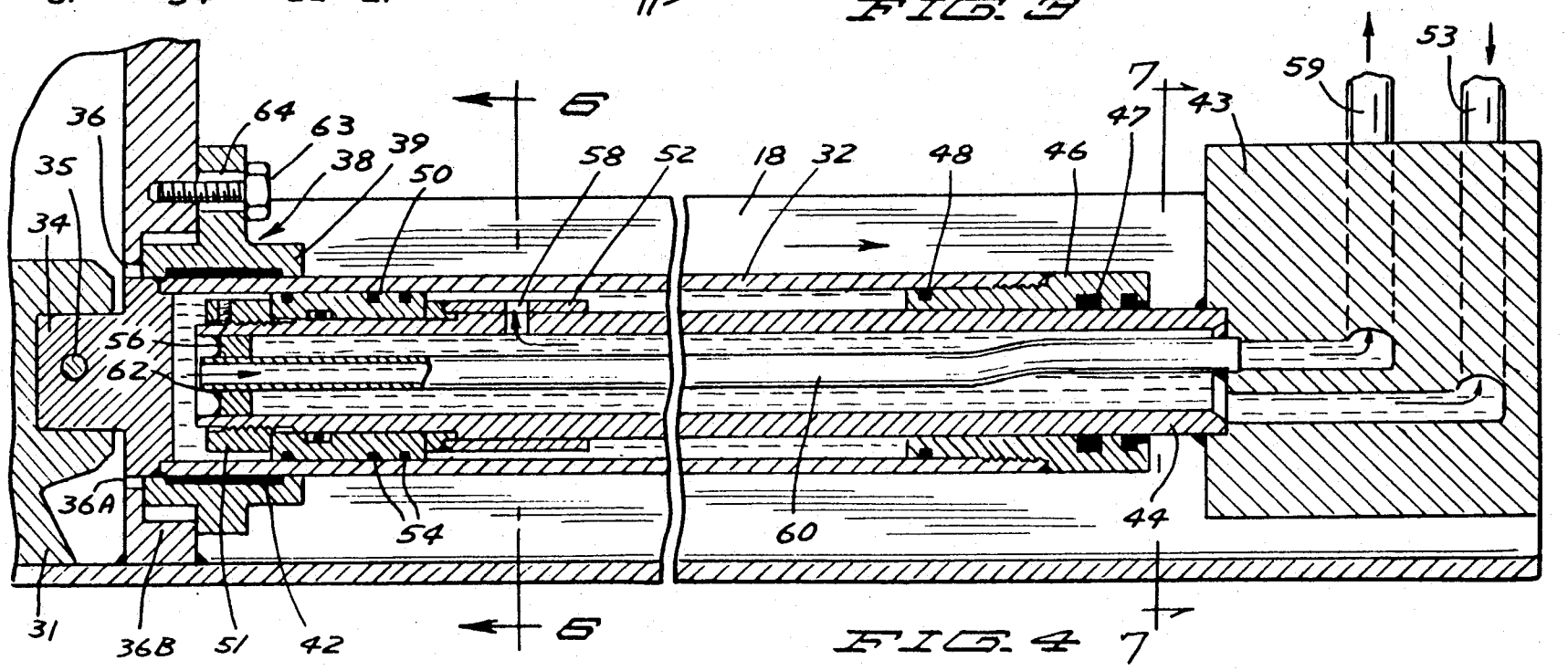
FIG. 4 is an enlarged foreshortened sectional view showing the hydraulic power unit of the material moving pump of FIG. 1 with the ram in a retracted position.

A ram assembly of pump 10 includes a plunger or ram 31 mounted for reciprocation in pumping chamber 22 and shown in a retracted position or in the rear of pumping chamber 22 in FIGS. 1, 2 and 4. Ram 31 has a generally V-shaped configuration to conform to the shape of pumping chamber 22 with suitable clearance, having downwardly convergent side walls terminating in an apex, a generally flat top, and a forwardly directed nose for purposes of efficiently moving material through chamber 22. As shown in FIG. 3, ram 31 is connected to one end of an elongate, tubular, preferably cylindrical housing 32. The forward end of housing 32 is closed by an end fitting 34 having a forwardly projected portion connected to ram 31 by a pin 35.

Figure 5:
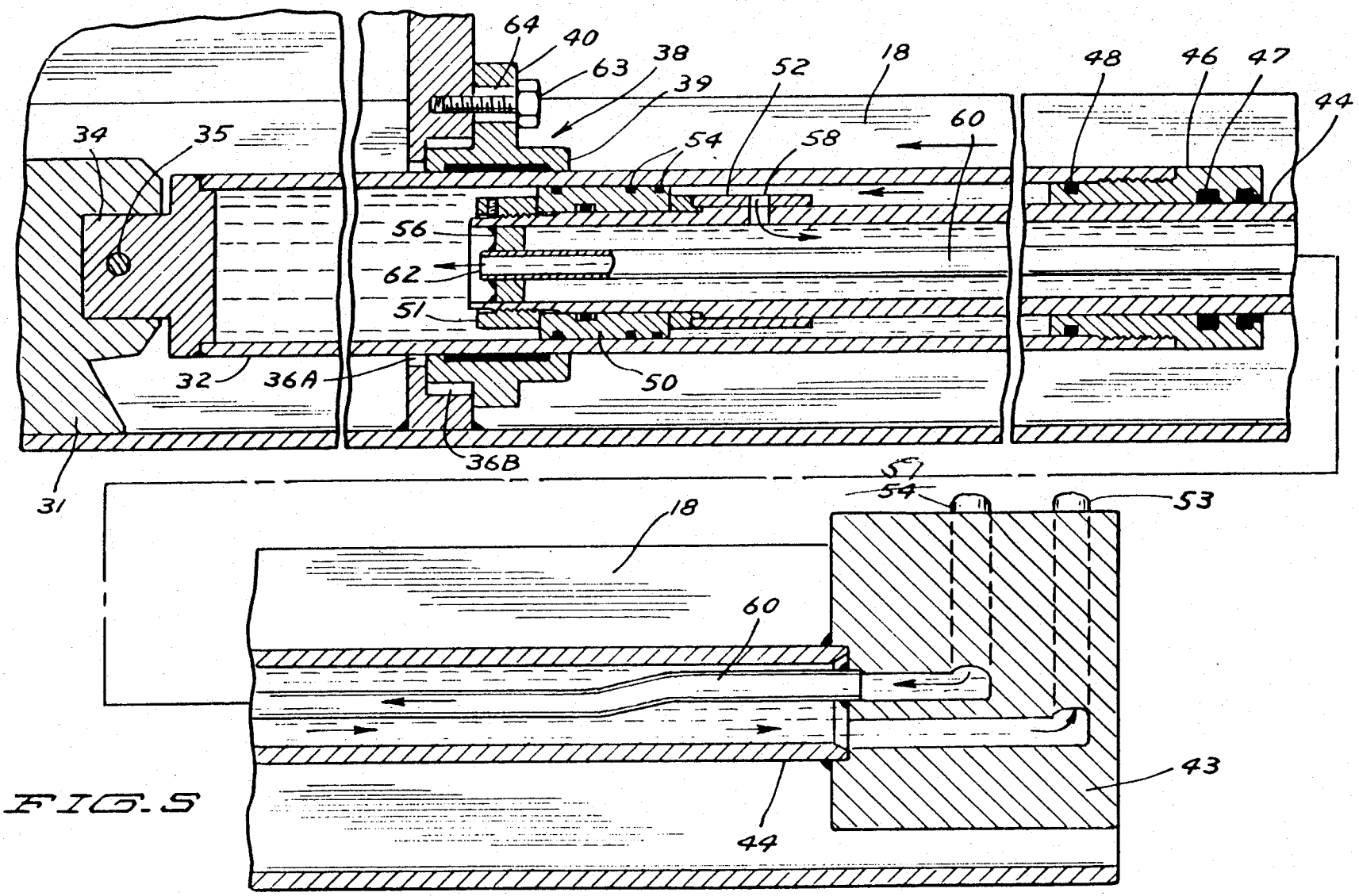
FIG. 5 is an enlarged foreshortened sectional view of that portion of the material moving pump shown in FIG. 4 with the ram in an advancing position.

Ram 31 and housing 32 are mounted for reciprocation in chamber 22 under the influence of a hydraulic motor of the piston cylinder variety. Back wall 21 of pumping chamber 22 has a ram assembly opening 36. A sleeve assembly 38 is adjustably mounted to the back wall 21 of pumping chamber 22 on the exterior side thereof relative to chamber 22. Sleeve assembly 38 includes an annular collar 39 of proper size to occupy opening 36, and a mounting flange or plate 40 connected to collar 39 and releasably and adjustably fastening it to end wall 21. Collar 39 has an annular interior recess or groove that contains a bearing sleeve 42 (FIGS. 4 and 5). Housing 32 is slidably assembled in bearing sleeve 42. Bearing sleeve 42 engages the outside wall of housing 32 in relatively fluid-tight relationship but is formed of a low frictional coefficient material to readily permit sliding movement of housing 21, such as a suitable plastic type material as that sold under the trademark Teflon.

As shown in FIGS. 1 and 3, housing 32 extends through opening 36 and rearwardly a substantial distance, shown in the rearwardly retracted position in FIG. 1 and advancing on a working stroke in FIG. 3. Side walls 17, 18 of pump 10 extend rearwardly a substantial distance of pumping chamber 22 to form a support for a block assembly 43 as well as a guide means or means for accurate alignment of the hydraulic power unit and ram assembly upon the correct pumping axis of pump 10 with respect to pumping chamber 22 as will be more fully described. Block assembly 43 is securely mounted at the rearward end of side walls 17, 18. A shaft 44 is secured at its rearward end in cantilever fashion to block assembly 43 as by welding, and extends in a forward direction along the longitudinal pumping axis of pump 10 so to be fixed in stationary relationship relative to pumping chamber 22. Shaft 44 is preferably also cylindrical and is installed in the end of tubular housing 32 opposite ram 31. The rearward end of housing 32 and shaft 44 comprise portions of a hydraulic power unit for reciprocation of housing 32 and ram 31 in pumping chamber 22. The power unit can be located completely external to and remote from the pumping chamber 22 to eliminate the possibility of contamination of pumping chamber 22 and material moved through it by the power unit.

FIG. 4 is a sectional view showing the ram assembly being retracted by the hydraulic power unit and in a substantially fully retracted position, and FIG. 5 is a sectional view like that of FIG. 4 showing the ram assembly in an advanced position and being advanced by the hydraulic power unit during a power stroke. As shown in these figures, an end gland 46 is assembled by threaded engagement to the rearward end of housing 32. Gland 46 has interior annular recesses that contain O-rings 47 or other suitable means for establishing a slidable, fluid tight relationship between shaft 44 and the end of housing 32 to permit reciprocal movement.

A piston 50 is secured to the shaft 44 in housing 32 and can be located near the end thereof. A retaining ring 51 is threaded on the end of shaft 44 and secured by a set-screw to retain piston 50 in proper position. A stop collar 52 is located on shaft 44 in adjacent relationship to piston 50 opposite retaining ring 51. A plurality of piston rings 54 are positioned in annular peripheral grooves on piston 50 to maintain sliding and sealing relationship with the interior walls of housing 32.

Shaft 44 carries internal hydraulic conduits for introduction of hydraulic fluid into the gland side and the blind side of the ram assembly. The gland side of the ram assembly is defined as internal volume of housing 32 between the piston 50 and the pressure bulkhead formed by end fitting 38 closing the ram end of housing 32. Alternatively, a pressure bulkhead could be positioned further interiorly of housing 32. The blind side of the ram assembly is interior volume of housing 32 where hydraulic fluid under pressure acts upon the opposite side of piston 50 or the volume between piston 50 and the pressure bulkhead provided by end gland 46.

Shaft 44 is equipped with two hydraulic passages or conduits connected to block assembly 43 which in turn are connected to a source of hydraulic fluid under pressure (not shown). One hydraulic fluid conduit is formed by the interior of shaft 44. The other is formed by a tube centrally disposed in the shaft 44. Referring again to FIGS. 4 and 5, a first hydraulic fluid conduit or passage 53 in block assembly 43 is connectable at one end to a remote pressurized hydraulic fluid source (not shown) and at the other end communicates with the interior of shaft 44 at the end fixed to block assembly 43. A pressure bulkhead 56 is installed in shaft 44 toward the end thereof interior to housing 32. One or more ports 58 are located in the side wall of shaft 44 open between the interior of shaft 44 and the interior of housing 32 on the blind side of the ram assembly or the side between the piston 50 and the end gland 46.

A second hydraulic fluid conduit or passage 59 in block assembly 43 is connectable at one end to the remote hydraulic fluid source and at the other end to an elongate hydraulic fluid tube 60 located interiorly of shaft 44. Tube 60 extends substantially the length of shaft 44. One end of tube 60 is connected in fluid tight relationship to the second fluid passage 59 in block assembly 43. The opposite end 62 passes through a suitable opening provided in the pressure bulkhead 56 of shaft 44 and is open to the interior of housing 32 on the gland side of ram assembly or the side between the piston 50 and the pressure bulkhead provided by the end fitting 34.

In use of pump 10, during the power stroke as shown in FIGS. 3 and 5, hydraulic fluid under pressure is introduced through the second fluid passage 59 with a corresponding return of hydraulic fluid through the first fluid passage 53 of block assembly 43. Fluid passes through the tube 60 and exits end 62 providing pressure between the bulkhead wall of end fitting 34 and piston 50 to advance ram 31 and housing 32 in pumping chamber 22 moving material 28 through the transition end of pump 10 against the influence of the open valve plate 26. Upon the return stroke of FIG. 4, fluid is introduced through the first fluid passage 53 of block assembly 43, with a corresponding return of fluid through the second fluid passage 59. Fluid moves through shaft 44 through ports 58 to the blind side of the ram assembly. Pressure exerted between piston 50 and end gland 46 moves housing 32 rearwardly along shaft 44, retracting ram 31 in pumping chamber 22.

An important consideration in the installation and maintenance of a reciprocating pump powered by a linear hydraulic power unit is proper alignment of the power unit relative to the pumping chamber housing so that the power unit reciprocates on a linear axis as coincident as possible with the design pumping axis of the machine. Misalignment will reduce pump efficiency and cause undue wear or damage to the ram assembly. Proper alignment is necessary upon installation of the power unit and again each time it is disassembled for service. Periodic alignment is desirable as the power unit becomes worn from use.

For purposes of adjusting the alignment of the hydraulic power unit of housing 32 and shaft 44, sleeve assembly 38 is adjustably mounted on pump wall 21 for up and down and sideways movement of collar 39. As shown in FIG. 4, a mounting bolt 63 is installed in an oversize hole 64 in mounting plate 40 and is securely threaded into back wall 22. The cross dimension of the head of mounting bolt 63 is sufficient to span the diameter of oversize hole 64 enabling the bolt to be brought into tight bearing relationship with the plate 40 in the vicinity of the hole 64. Ram assembly opening 36 in back wall 22 has an inward facing portion 36A and an outward facing portion 36B of slightly larger diameter than the inward facing portion 36A. Outward facing portion 36B is larger than the outside diameter of collar 39 providing a measure of clearance for up and down and sideways movement for adjustment of collar 39. Inward portion 36A is smaller than the outside diameter of collar 39 but larger than the inside diameter by an amount sufficient for confronting edges of the collar 39 and opening 36A to maintain sealing relationship upon movement adjusting the position of collar 39. The position of collar 39 and accordingly the alignment of housing 32 is adjusted by loosening bolt 63 and moving collar 39 about in opening 36, and again tightening bolt 63.

Figure 7:
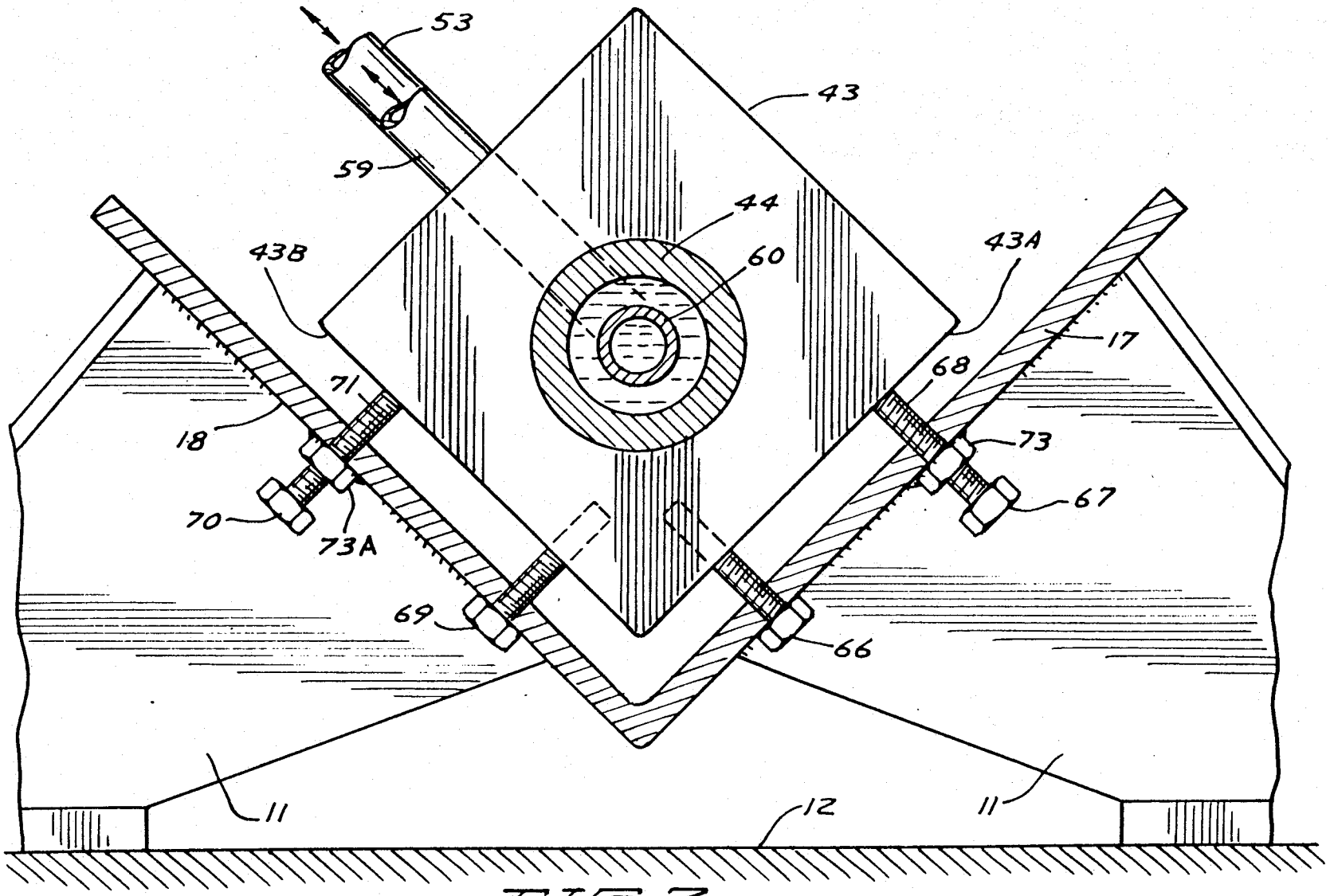
FIG. 7 is an enlarged sectional view of another portion of a material moving pump of FIG. 4 taken along the line 7—7 thereof.

Apparatus for adjustment of the opposite end of the power unit of the ram assembly is shown in FIG. 7 which comprises apparatus for adjustment of the position of the block assembly 43. A first mounting bolt 66 extends through an opening in first side wall 17 and is securely threaded into a suitable opening provided in the confronting side wall 43A of block assembly 43. A first adjusting bolt 67 has a shank 68 threadably engaged in a nut 73 welded to wall 17 and pass through a suitable opening in side wall 17. The end of shank 68 is in bearing relationship against the side wall 43A of block assembly 43. A second mounting bolt 69 passes through an opening in the second side wall 18 and is securely threaded in a suitable opening provided in side wall 43B of block assembly 43 adjacent to and angularly disposed relative to the side wall 43A. A second adjusting bolt 70 has a shank 71 threadably engaged in a second nut 73A welded to side wall 18 and passes through a suitable opening in second sidewall 18. The end of shank 71 is positioned in bearing relationship to the side wall 43B of block assembly 43. Adjustment of the position of block assembly 43 is accomplished by loosening the mounting bolts 66, 69, then locating the block assembly 43 in the desired position through manipulation of the adjusting bolts 67, 70. Once the adjustment is made, mounting bolts 66, 69 are tightened.

Alignment of shaft 44 and housing 32 is done visually through the use of convergent side walls 17, 18 as a horizontal reference guide. Side walls 17, 18 are accurately, symmetrically orientated with respect to the design pumping axis of pumping chamber 22 and form a V-shaped trough. Spacing the position of the shaft 44 and housing 32 in equal distant relationship to each of the side walls 17, 18 along the length thereof assures correct alignment relative to the design pumping axis of pump 10. This visual procedure is facilitated by the length and covergence of side walls 17, 18. While side walls 17, 18 are continuous, the task could be accomplished with only two spaced apart side wall portions having convergent walls to provide reference by line-of-sight indication of proper and equal spacing of the cylinder and shaft of the hydraulic motor. While there is illustrated an apparatus and procedure for the correct alignment of the power unit of a pump of the type described herein, it will be apparent that the same apparatus is usable to align the cylinder of a hydraulic power unit on a pump of the type shown and described in U.S. Pat. No. 4,322,023 issued Mar. 30, 1982 to Olson entitled Material Moving Apparatus.

The embodiments of the invention in which an exclusive property or privilege is claimed are defined as follows:

1. A material moving pump comprising:

a pump housing including first and second side walls orientated with respect to each other in an upwardly open V-shape and having interior walls defining a longitudinal pumping chamber with a longitudinal pumping axis, a rearward end wall at the rearward end of the pumping chamber, a material inlet means toward the rearward end of the pumping chamber, and a forward end having a material outlet;

a pumping ram located in the pumping chamber for reciprocal movement between the rearward end of the chamber and the forward end of the chamber to move material out of the material outlet;

an elongate tubular housing having a forward end and a rearward end, said tubular housing fixed to the ram at the forward end and open at the rearward end and extended rearwardly from the ram generally aligned with the pumping axis of the chamber;

said end wall of the pumping chamber having an opening for the tubular housing, said tubular housing extending through said opening, and bearing means in the opening making sealing and sliding engagement with the tubular housing permitting reciprocal movement of the tubular housing in the pumping chamber;

means for adjustment of the position of the bearing means holding the tubular housing in the opening in the end wall of the pumping chamber for purposes of adjusting the alignment of the tubular housing relative to the pumping axis of the pumping chamber including a collar, a bearing sleeve located in the collar and engaging the tubular housing, a mounting plate attached to the sleeve, an attaching bolt threadable into an attaching bolt opening in the outer surface of the end wall of the pumping chamber, said attaching bolt having a shank and a head, said mounting plate having a mounting bolt hole that is oversized with respect to the mounting bolt shank and of less dimension than the mounting bolt head;

an elongate linear tubular shaft having a forward end and a rearward end, and shaft support means supporting the rearward end of the shaft in cantilever fashion at a location spaced rearwardly of the pump housing and extended forwardly toward the pump housing generally in longitudinal alignment with the pumping axis of the pumping chamber, said shaft support means including a rearward extension of the V-shaped side walls forming a V-shaped trough to serve as means for visual alignment of the position of the tubular housing and the shaft relative to the pumping axis of the pumping chamber, said support means for the shaft also including a block assembly located on the end of the V-shaped side walls, and means for adjustment of the position of the block assembly for purposes of aligning the shaft along the pumping axis of the pumping chamber, said forward end of the shaft being moveably installed in the rearward end of the tubular housing, and gland means closing the rearward end of the tubular housing and in sliding and sealing engagement with the shaft;

a piston installed on the shaft toward the forward end thereof and located in the tubular housing, said piston in sliding and sealing engagement with the interior walls of the tubular housing;

hydraulic means for reciprocation of the tubular housing with respect to the piston for reciprocating of the ram in the pumping chamber.

2. The material moving pump of claim 1 wherein: the adjusting means for the block assembly includes a first mounting bolt installed through a first of the side walls and releasably threaded into the block assembly, and a first adjusting bolt threadably engaged in the first side wall and having a shank in bearing relationship to the block assembly;

a second mounting bolt installed through the second side wall and releasably threaded into the block assembly, and a second adjusting bolt threadably engaged in the second side wall and having a shank in bearing relationship to the block assembly.

3. Alignment apparatus for adjusting longitudinal alignment of a hydraulic power unit on a material moving pump of the type having a pump housing with walls defining a pumping chamber, a ram mounted in the pumping chamber for reciprocal movement along a design pumping axis between a rearward end of the pumping chamber and a forward end of the pumping chamber, a material outlet at the forward end of the pumping chamber, comprising:

a rear wall connected to the pump providing a rear wall to the pumping chamber, an opening in the rear wall of the pumping chamber for connection of the ram to a section of a hydraulic motor of the type having one section including a cylinder and another section that includes a shaft for linear reciprocation in and out of the cylinder to move the ram in reciprocal fashion;

a sleeve assembly including a collar for close engagement of a section of a hydraulic motor, said collar having an outer dimension less than that of the opening in the rear wall of the pumping chamber permitting installation of the collar in the opening of the pumping chamber wall and relative movement thereon to adjust the position of the sleeve to align the section of the hydraulic motor with respect to the design pumping axis of the pumping chamber;

a mounting plate attached to the collar and having a dimension greater than the dimension of the opening in the rear wall of the pump so as to span the rear opening of the pump when the collar is installed in the rear opening;

connecting means cooperating between the mounting plate and the exterior surface of the rear wall of the pumping chamber for securing the collar in an adjusted position.

4. The alignment apparatus of claim 3 wherein: the connecting means includes an attaching member having a head and having a shank releasably connectable to the exterior surface of the rear wall of the pumping chamber; said mounting plate having a hole that is oversized with respect to the shank of the attaching member and of a dimension less than the head of the attaching member for securing the collar in adjusted position relative to the opening in the rear wall of the pumping chamber.

5. The alignment apparatus of claim 4 including: a bearing sleeve installed inside the collar for making sliding and sealing engagement with a tubular housing portion of a hydraulic motor connected to the ram.

6. An alignment apparatus for adjusting longitudinal alignment of a hydraulic power unit on a material moving pump of the type having a pump housing with walls defining a pumping chamber, a rear wall of the pumping chamber, a ram mounted in the pumping chamber for reciprocal movement along a design pumping axis between a rearward end of the pumping chamber and a forward end of the pumping chamber, a material outlet at the forward end of the pumping chamber, an opening in the rear wall of the pumping chamber for connection of the ram to a section of a hydraulic motor of the type having one section including a cylinder and another section that includes a shaft for linear reciprocation in and out of the cylinder to move the ram in reciprocal fashion, comprising:

a sleeve assembly including a collar for close engagement of a section of a hydraulic motor, said collar having an outer dimension less than that of the opening in the rear wall of the pumping chamber permitting installation of the collar in the opening of the pumping chamber wall and relative movement thereon to adjust the position of the sleeve to align the section of the hydraulic motor with respect to the design pumping axis of the pumping chamber; and connecting means cooperating between the sleeve assembly and the exterior surface of the back wall of the pumping chamber for securing the collar in an adjusted position, including a mounting plate attached to the collar; an attaching member having a head and having a shank releasably connectable to the exterior surface of the rear wall of the pumping chamber; said mounting plate having a hole that is oversized with respect to the shank of the attaching member and of a dimension less than the head of the attaching member for securing the collar in adjusted position relative to the opening in the rear wall of the pumping chamber;

support means for a support of a section of the hydraulic power unit, said support means located behind the pump housing and including first and second side walls having portions orientated in a V-shaped configuration in symmetrical relationship to a rearward longitudinal projection of the pumping axis of the pumping chamber to provide visual reference of the alignment of the hydraulic power unit relative to the pumping axis of the pumping chamber.

7. The alignment apparatus of claim 6 wherein: the support means includes a block assembly located at the rearward end of the first and second side walls for supporting a section of the hydraulic power unit, means for adjustment of the position of the block assembly with respect to the side walls including a first mounting bolt installed through a first of the side walls and releasably threaded into the block assembly, and a first adjusting bolt threadably engaged in the first side wall and having a shank in bearing relationship to the block assembly; a second mounting bolt installed through the second side wall and releasably threaded into the block assembly, and a second adjusting bolt threadably engaged in the second side wall and having a shank in bearing relationship to the block assembly.

8. A material moving pump comprising:

a pump housing having interior walls defining a longitudinal pumping chamber with a longitudinal pumping axis, a rearward end wall at the rearward end of the pumping chamber, a material inlet means toward the rearward end of the pumping chamber, and a forward end having a material outlet;

a pumping ram located in the pumping chamber for reciprocal movement between the rearward end of the chamber and the forward end of the chamber to move material out of the material outlet;

an elongate tubular housing having a forward end and a rearward end, said tubular housing fixed to the ram at the forward end and open at the rearward end and extended rearwardly from the ram generally aligned with the pumping axis of the chamber;

said end wall of the pumping chamber having an opening for the tubular housing, said tubular housing extending through said opening, and bearing means in the opening making sealing and sliding engagement with the tubular housing permitting reciprocal movement of the tubular housing in the pumping chamber;

means for adjustment of the position of the bearing means holding the tubular housing in the opening in the end wall of the pumping chamber for purposes of adjusting the alignment of the tubular housing relative to the pumping axis of the pumping chamber;

an elongate linear shaft having a forward end and a rearward end, and shaft support means supporting the rearward end of the shaft in cantilever fashion at a location spaced rearwardly of the pump housing and extended forwardly toward the pump housing generally in longitudinal alignment with the pumping axis of the pumping chamber, said forward end of the shaft being moveably installed in the rearward end of the tubular housing, and gland means closing the rearward end of the tubular housing and in sliding and sealing engagement with the shaft;

said shaft support means including holding means and means for adjustment of the position of the holding means for purposes of aligning the shaft along the pumping axis of the pumping chamber;

a piston installed on the shaft toward the forward end thereof and located in the tubular housing, said piston in sliding and sealing engagement with the interior walls of the tubular housing;

hydraulic means for reciprocation of the tubular housing with respect to the piston for reciprocating of the ram in the pumping chamber.

9. The material moving pump apparatus of claim 8 wherein: said shaft is tubular and said hydraulic means is at least partically located in the shaft.

10. The material moving pump of claim 9 wherein: said piston divides the interior volume of the tubular housing into a gland side located forward of the piston and a blind side located rearwardly of the piston, and including means for alternately introducing hydraulic fluid under pressure to the gland side of the tubular housing and to the blind side of the tubular housing.

11. The material moving pump of claim 9 wherein: said hydraulic means includes first and second hydraulic fluid conduits located in the support means of the shaft, said tubular housing having a closed interior, an elongate tube installed in the shaft, closure means located toward the forward end of the shaft forming a hydraulic fluid chamber in the shaft, said elongate tube having a forward end passing through the closure means and open to the housing interior ahead of the piston, and a rearward end connected to the second hydraulic conduit, said first hydraulic fluid conduit connected to the chamber of the shaft, and at least one port in a side wall of the shaft open between the chamber of the shaft and the interior of the housing at a location rearward of the piston, said first and second hydraulic fluid conduits connected to a means of hydraulic fluid under pressure for alternating hydraulic fluid under pressure between the first and second hydraulic conduits.

12. The material moving pump of claim 11 wherein: said pump housing includes first and second side walls orientated with respect to one another in an upwardly open V-shape.

13. The material moving pump of claim 12 wherein: support means for the shaft includes a rearward extension of the V-shape side walls forming a V-shape trough to serve as means for visual alignment of the position of the tubular housing and the shaft relative to the pumping axis of the pumping chamber.

14. The material moving pump of claim 8 wherein: bearing means holding the tubular housing includes a collar, a bearing sleeve located in the collar and engaging the tubular housing, a mounting plate attached to the sleeve, an attaching bolt threadable into an attaching bolt opening in the outer surface of the end wall of the pumping chamber, said attaching bolt having a shank and a head, said mounting plate having a mounting bolt hole that is oversized with respect to the mounting bolt shank and of less dimension than the mounting bolt head.

15. The material moving pump of claim 14 wherein: support means for the shaft includes a block assembly located on the end of the V-shape side walls, and means for adjustment of the position of the block assembly for purposes of aligning the shaft along the pumping axis of the pumping chamber.

16. The material moving pump of claim 15 wherein: the adjusting means for the block assembly includes a first mounting bolt installed through a first of the side walls and releasably threaded into the block assembly, and a first adjusting bolt threadably engaged in the first side wall and having a shank in bearing relationship to the block assembly;

a second mounting bolt installed through the second side wall and releasably threaded into the block assembly, and a second adjusting bolt threadably engaged in the second side wall and having a shank in bearing relationship to the block assembly.

17. The material moving pump of claim 8 wherein: said housing includes first and second side walls orientated in an upwardly open V-shape configuration, said support means for a shaft including a rearward extension of the V-shaped side walls forming a V-shaped trough to serve as means for visual alignment of the position of the tubular housing and shaft.

18. The material moving pump of claim 17 including: means for adjustment of the position of the bearing means holding the tubular housing in the opening in the end wall of the pumping chamber for purposes of adjusting the alignment of the tubular housing relative to the pumping axis of the pumping chamber.

19. The material moving pump of claim 18 wherein: bearing means holding the tubular housing includes a collar, a bearing sleeve located in the collar and engaging the tubular housing, a mounting plate attached to the sleeve, an attaching bolt threadable into an attaching bolt opening in the outer surface of the end wall of the pumping chamber, said attaching bolt having a shank and a head, said mounting plate having a mounting bolt hole that is oversized with respect to the mounting bolt shank and of less dimension than the mounting bolt head.

* * * * *

UNITED STATES PATENT AND TRADEMARK OFFICE

CERTIFICATE OF CORRECTION

PATENT NO. : 5,030,069

DATED : July 9, 1991

INVENTOR(S) : David V. Olson

It is certified that error appears in the above-identified patent and that said Letters Patent is hereby corrected as shown below:

Col. 2, line 38, "orientated" should be -- oriented --.

Col. 2, line 44, after "chamber" insert -- 22 --.

Col. 5, line 42, delete "pass" and insert -- passes --.

Col. 9, line 64, delete "partically" and insert -- partially --.

Col. 10, line 25, delete "orientated" and insert -- oriented --.

Col. 10, line 63, delete "orientated" and insert -- oriented --.

Signed and Sealed this

Third Day of November, 1992

*Attest:*

*Attesting Officer*

DOUGLAS B. COMER

*Acting Commissioner of Patents and Trademarks*